US006481612B1

(12) United States Patent
Mangone, Jr.

(10) Patent No.: US 6,481,612 B1
(45) Date of Patent: Nov. 19, 2002

(54) FASTENING DEVICE DELIVERY TOOL WITH PERPENDICULAR RAM DRIVEN BY A REPEATABLE ARCUATE FORCE MEMBER

(76) Inventor: Peter G. Mangone, Jr., 28600 Buchanan Dr., Evergreen, CO (US) 80439

( * ) Notice: Subject to any disclaimer, the term of this patent is extended or adjusted under 35 U.S.C. 154(b) by 0 days.

(21) Appl. No.: 10/114,285

(22) Filed: Apr. 2, 2002

(51) Int. Cl.[7] ..... B25C 1/04

(52) U.S. Cl. ..... 227/130; 227/134; 227/142; 227/148; 227/140

(58) Field of Search ..... 227/130, 109, 227/134, 148, 142, 140

(56) References Cited

U.S. PATENT DOCUMENTS 2,501,703 A * 3/1950 Wember ..... 227/134
3,012,247 A * 12/1961 Sillars ..... 227/148
3,110,898 A * 11/1963 Haubold ..... 227/134
3,506,178 A * 4/1970 Brunelle ..... 227/134
4,349,143 A * 9/1982 Ewig ..... 227/134
4,380,313 A * 4/1983 Klaus et al. ..... 227/130
4,867,366 A 9/1989 Kleinholz
5,007,573 A * 4/1991 Uuskallio ..... 227/148
5,350,023 A 9/1994 Klemm
6,021,982 A 2/2000 Mangone

* cited by examiner

*Primary Examiner*—Scott A. Smith
(74) *Attorney, Agent, or Firm*—Gardner Carton & Douglas

(57) ABSTRACT

A delivery tool is provided for driving fastening devices, for example, U-shaped fastening devices which mount tubing to a surface. The delivery tool has a pivoting structure, including a driving member and a base member. The delivery tool includes a movable ram which is axially guided within the base member to maintain an orientation perpendicular to the surface to drive the fastening devices in a straight manner. A pneumatic impact mechanism is housed within the driving member to assist the ram. The impact mechanism has a concave force delivery member shaped to contact the ram at a generally radial orientation relative thereto, thereby optimally delivering the impact forces to the ram regardless of the angular position of the driving member relative to the base member.

16 Claims, 6 Drawing Sheets

FASTENING DEVICE DELIVERY TOOL WITH PERPENDICULAR RAM DRIVEN BY A REPEATABLE ARCUATE FORCE MEMBER

FIELD OF THE INVENTION

The present invention generally relates to surface penetrating fastening devices and more particularly to a delivery tool design and method to controllably affix cylindrical objects to planar surfaces with the assistance of an impact mechanism.

BACKGROUND OF THE INVENTION

Electric, manual, and pneumatic tools are generally known for driving fastening devices which affix tubing, cabling, and other cylindrical objects to a surface. In building construction, for example, tubing is used in radiant heating systems, water delivery systems, gas supply systems, air conditioning, etc. As a part of installing such systems, the tubing is conventionally mounted against planar surfaces. For example, when installing certain types of in-floor heating systems, an arrangement of tubing is affixed to the underside of flooring or on top of the flooring base then covered with concrete. In other applications, tubing is frequently mounted to other types of planar surfaces, such as wooden joists, studs, or walls.

One of the methods of mounting tubing to a surface entails the use of specially configured fastening devices. Such fastening devices are provided in various configurations, one of which generally includes a U-shaped body having a cutout dimensioned to receive a tubing cross-section. The U-shaped body generally straddles the tubing and has parallel sides that respectively abut the mounting surface on opposite sides of the tubing. The fastening device also includes at least one surface penetrating member, such as a nail. Prior to use, each of the nail(s) is at least partially embedded in a respective one of the parallel sides of the U-shaped body. When the fastening device is mounted against the surface, a portion of each of the nails is driven through a portion of the body, projecting from the U-shaped body toward and against the mounting surface as the nail(s) is driven into the surface. Such fastening devices are described in U.S. Pat. Nos. 4,801,061, 4,801,064, and 5,350,267 of Peter G. Mangone, Jr.

Delivery tools have been developed to fasten the U-shaped fastening devices onto surfaces. Such tools contain a magazine of fastening devices and a manually actuated structure to sequentially dispense fastenings device and drive the nail(s) of the fastening devices into a surface. For example, one such manual delivery tool is available from the Plumbing Products Division of Peter Mangone, Inc. in Lakewood, Colo. 80228. This product is known as the "RB-5 Clip Gun."

While prior art delivery tools are useful and effective, they have conventionally been manually actuated and utilize driving forces repeatedly applied until the nails or surface penetrating members have been fully driven to their desired depth and not over driven so as to injure the tubing or rupture the housing. As the amount of force necessary to accomplish this cannot be predetermined due to the different resistance properties of various mounting surface materials and thicknesses, conventional tools that deliver a single predetermined driving force have been unsuitable, as the single force may be inadequate or too great, resulting in driving the nails incompletely or too far. For example, single-fire pneumatically actuated devices have not been considered suitable for this reason. Accordingly, the need exists for a power-assisted fastening device delivery tool that can deliver multiple driving forces until, and only until, the nails or surface penetrating members are driven into the surface to a desired depth.

SUMMARY OF THE INVENTION

The present invention provides a tool and method of controllably applying fastening devices, such as clips, staples, or other surface penetrating structures. The tool drives the fastening devices by the repeated action of an arcuate force transmitted through a perpendicularly driven ram.

For example, in a preferred embodiment, the invention provides an application apparatus, referred to herein as a "delivery tool", which includes a driving member operable to deliver pneumatically actuated driving forces. Said driving member is pivotally mounted relative to a base member that contains the fastening devices to be applied. The base member has a chamber for holding a plurality of fastening devices so that a next available one of the fastening devices is automatically delivered to a position preparatory to being driven. The base member has at least one bottom surface adapted to position and support the delivery tool against a generally planar mounting surface. The driving member is pivotally mounted to the base member toward a rear end of the base member and slidably mounted to the base member toward a front end of the base member so as to facilitate movement along an arc resulting from pivotal motion between the driving member and the base member. Additionally, the fastening tool includes a ram which is slidably disposed near the front end of the base member and moves in a guided orientation generally perpendicular to the generally planar mounting surface. The ram is mounted to cooperate with the pivotal movement of the driving member relative to the base member so that the ram translates said movement in a perpendicular direction relative to the mounting surface as the driving member pivots. When moved, the ram contacts the surface penetrating member(s) of the fastening device, driving the surface penetrating member(s) into the mounting surface and pushing the fastening device from the chamber as the driving member is pivoted toward the base member and the drive force(s) is applied.

Furthermore, the fastening tool includes a repeatable impact mechanism mounted within the driving member. The impact mechanism has an actuatable piston slidable relative to the driving member. The piston has a force delivery member to transmit impact force from the piston to a proximal edge of the ram, the ram having a limited amount of movement other than its guided movement perpendicular to the mounting surface. In a preferred embodiment of the invention, the force delivery member has a concave face, and the proximal edge of the ram is convex and shaped to generally mate against a curvature of the concave face as the driving member pivots relative to the base member. As a result, the concave face contacts against the ram in a generally radial orientation relative to the curvature of the concave face.

According to an embodiment, the concave face and proximal edge of the ram are shaped so that the concave face delivers impact forces to the ram toward the chamber generally perpendicular to one mounting surface.

In an embodiment, a portion of the movement of the concave face can be along a front-rear direction relative to the ram.

In an embodiment, the concave face has a radius of curvature directly proportional to a radius of curvature of said arc. In various embodiments, the concave surface can be generally spherical or generally conical.

In an embodiment, the impact mechanism is pneumatically actuated substantially in the same manner as the PALM NAILER® manufactured by DANAIR® and is actuated to drive downwardly when the ram pushes up against the force delivery member.

In an embodiment, the base member is adapted to receive a section of tubing.

In an embodiment, each of the fastening devices includes: a generally U-shaped housing with a pair of sides; and a pair of nails, each of the nails being at least partially contained within a respective one of the sides; wherein the ram has a pair of tines which cooperate with and respectively drive the nails, driving portions of the nails to project from the U-shaped housing into the surface and pushing the fastening device from the chamber.

In an embodiment, the fastening tool includes a biasing member to urge the handle to pivot away from the base member.

An advantage of the present invention is that it provides a delivery tool which delivers accurate, repeated driving forces to nails of the fastening device in a controllable fashion.

Another advantage of the present invention is that it provides a delivery tool which is capable of driving surface penetrating members of the fastening device to a predetermined depth, thereby avoiding overdriving or underdriving the fastening device.

An advantage of the present invention is that it provides a delivery tool which drives fastening devices in a reliably perpendicular orientation relative to a mounting surface.

Yet another advantage of the present invention is that it provides a delivery tool which has an impact mechanism which efficiently and repeatedly delivers impact forces to the ram as the angle between the ram and the piston of the impact mechanism changes.

These and additional features and advantages of the present invention will be apparent from the figures, description and claims herein.

DETAILED DESCRIPTION OF THE PRESENTLY PREFERRED EMBODIMENT

Figure 1:
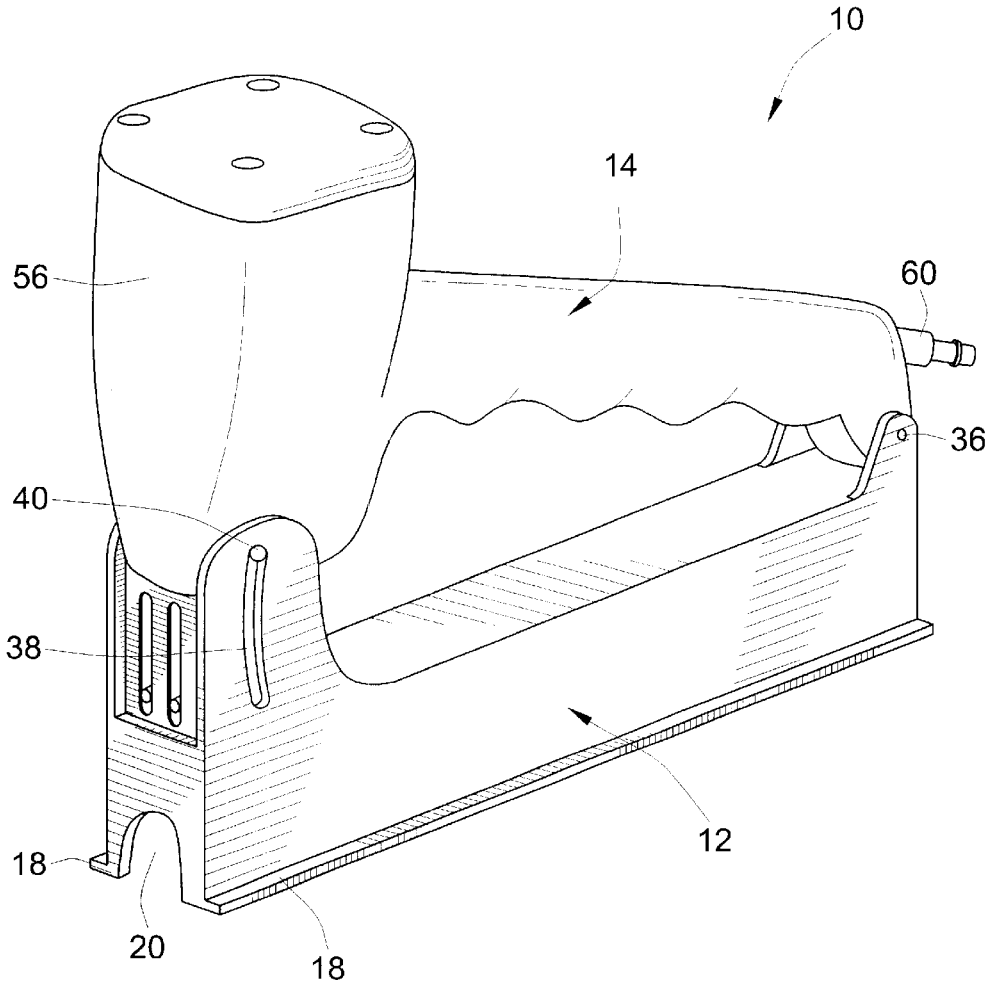
FIG. 1 is an isometric view of a delivery tool having features in accordance with teachings of the present invention.
Figure 4A:
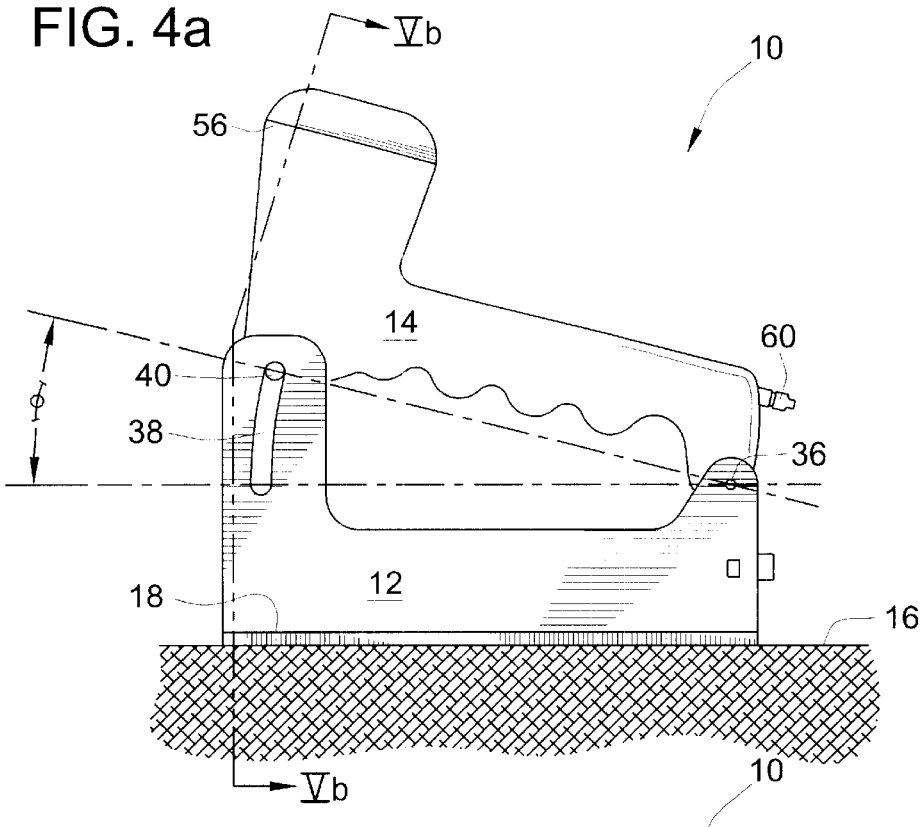
FIG. 4*a* is a side elevational view of the delivery tool of FIG. 1, the driving member in a position pivoted away from the base member.
Figure 4B:
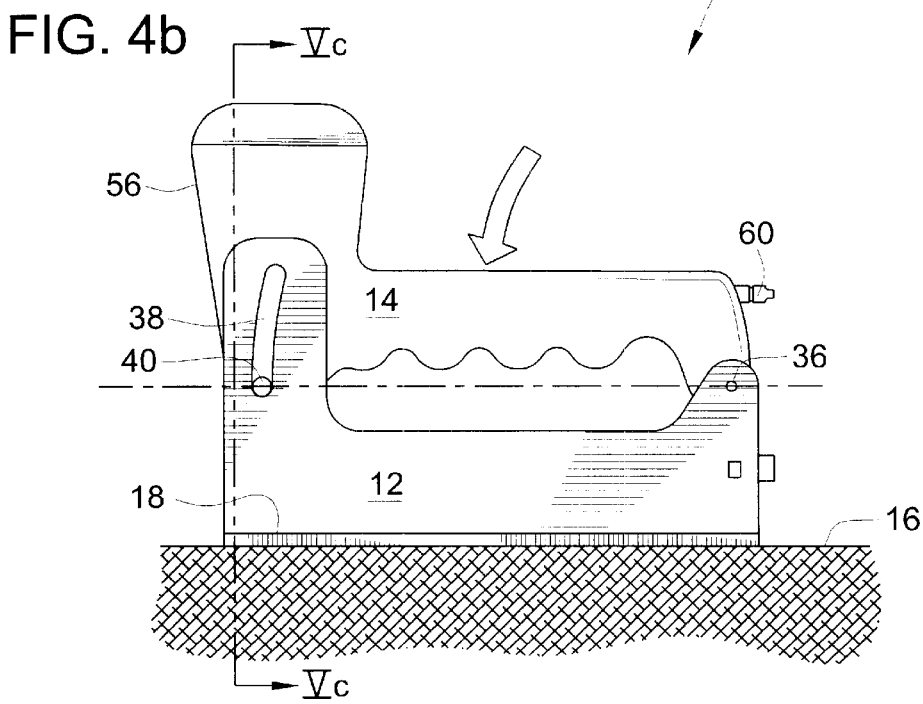
FIG. 4*b* is a side elevational view of the delivery tool of FIG. 1, the driving member in a position pivoted toward the base member.

Now referring to the drawings, wherein like numerals designate like components, a delivery tool 10 is illustrated in FIGS. 1, 4*a* and 4*b*. The delivery tool 10 generally includes a base member 12 and a driving member 14. The base member 12 is configured to support the delivery tool 10 against a generally planar mounting surface 16, such as plywood or some other material to which tubing is to be mounted. For example, in the illustrated embodiment, the base member 12 is shaped to have a pair of parallel bottom surfaces 18 defining flat, coplanar seating surfaces on which the base member can rest against the planar mounting surface 16. The base member 12 is shaped to include an arch 20 (FIG. 1) disposed between the bottom surfaces 18, permitting the delivery tool 10 to be positioned over a section of tubing 22 (FIGS. 5*a–c*) to be secured relative to the surface.

Figure 2:
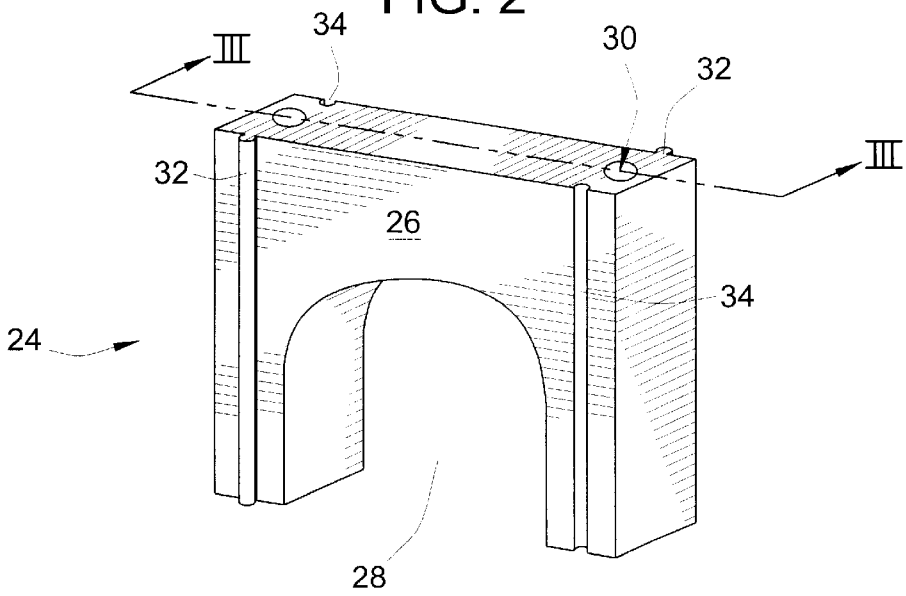
FIG. 2 is an isometric view of a fastening device which may be utilized to mount tubing to a surface with the delivery tool of FIG. 1.
Figure 3A:
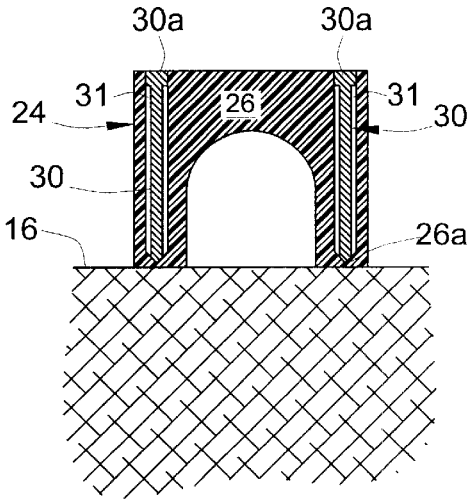
FIG. 3*a* is a sectional view of the fastening device as taken generally along line III—III of FIG. 2, the nails being contained within the parallel sides of the U-shaped housing prior to use.
Figure 3B:
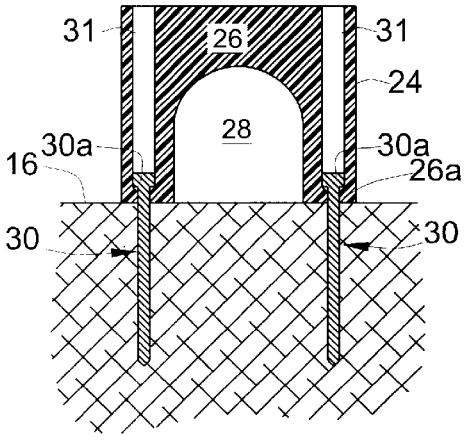
FIG. 3*b* is a sectional view of the fastening device of FIG. 3*a,* the nails being deployed to partially project from the U-shaped housing into the mounting surface.

The delivery tool 10 is configured to dispense and drive fastening devices, preferably of the type conventionally used to mount tubing relative to the mounting surface. Referring to FIGS. 2, 3*a* and 3*b,* an exemplary fastening device 24 includes a generally U-shaped housing 26 having a cut-out 28 dimensioned to receive a tubing cross-section. The U-shaped housing 26 and cutout 28 can be provided in various shapes and sizes for use with various tubing sizes. The housing 26 can be a unitary component, or it could be multiple components glued or fused together. The fastening device 24 also includes one or more nails 30. Prior to use, each of the nails 30 is at least partially contained within a respective passage 31 disposed through one of the parallel sides of the U-shaped housing 26, as shown in FIG. 3*a*. When the fastening device 24 is mounted against a surface, a portion of each of the nails 30 is driven from the housing 26, projecting into the mounting surface, as illustrated in FIG. 3*b*. Alternatively, the fastening device could be a staple.

So that the fastening device is rigidly mounted to the mounting surface 16, the nail 30 includes a head 30*a* which abuts against a shoulder 26*a* of the housing 26 which projects inwardly into the passage 31 at a bottom of the passage. The head 30*a* is shaped relatively wider than opening through the shoulder 26*a,* thereby preventing the nail 30 from pulling completely through the passage 31. The nail 30 is preferably driven an appropriate distance so that the head 30*a* contacts the shoulder 26*a,* as illustrated in FIG. 3*b*. The housing 24 is commonly made of a thermoplastic resin such as high density polyethylene, and the nails 30 are made of a metal or alloy, such as steel. The shoulder 26*a* preferably deforms slightly when the nail 30 is fully driven as shown in FIG. 3*b* so that the housing 26 is held tightly by the nail against the mounting surface 16. In known fastening devices, for example, it is desirable to drive the nail 30 to a depth such that the head is about one-eighth inch from the top of the mounting surface 16. It is undesirable to drive the nail 30 to a depth beyond that illustrated in FIG. 3*b*. If the nail 30 is over-driven, the head 30*a* can tear or deform the shoulders 26*a* so substantially that the shoulder 26*a* cannot provide adequate structural support.

Advantageously, the delivery tool 10 reliably drives the nail(s) of a fastening device to a predetermined depth and no further. According to an aspect of the invention, the delivery tool 10 is effective to deliver one of the fastening devices by transmitting numerous quick power-assisted impacts to the nails, yet the delivery tool will not overdrive the nails beyond a predetermined depth. The delivery tool drives the nails to the predetermined depth, then stops, preventing damage to the housing of a fastening device which could otherwise occur. As will be explained in greater detail below, the delivery tool 10 includes an actuator which provides power assistance to drive the fastening devices, wherein the actuator automatically ceases at a point when the fastening device has been driven to the predetermined depth.

The delivery tool 10 can hold at least one fastening device 24, and preferably a plurality of fastening devices 24, within the base member 12. In an embodiment, a magazine or stack of fastening devices can be loaded into a channel interiorly of the base member, as will be described in greater detail below in connection with FIGS. 5*a–c* and 6*a–b*. So that the fastening devices are conveniently interlockable to each other in a stack for loading, in an embodiment, each of the fastening devices 24 includes ridges 32 and grooves 34 which are cooperatively shaped, as generally illustrated in FIG. 2. The ridges 32 and grooves 34 of each fastening device 24 are arranged for matable locking with another like fastening device 24. As illustrated, in FIG. 2, for example, a front of the fastening device 24 has a groove 34 along one of the sides and a parallel ridge 32 along the opposite side. Another ridge 32 and groove 34 are similarly disposed on the rear of the fastening device 24. The ridge 32 and groove 34 on the front and/or rear each fastening device can be mated with the respective ridge and groove of an adjacent fastening device. So that a fastening device can be readily separated from the stack in a driving direction, ridges and grooves can slide with respect to each other, permitting a fastening device to be pushed free of the adjacent fastening devices in the stack in a direction of the ridges and grooves.

As illustrated in FIGS. 4*a* and 4*b,* the driving member 14 is shaped to be gripped by the hand of a user and is pivotably mounted to the base member 12. More particularly, at a rear end of the delivery tool 10, the driving member 14 is pivotally mounted to the base member 12 by a pin 36 or other hinge structure. At a front of the delivery tool 10, the driving member 14 is slidably mounted to the base member 12 to accommodate a limited range of pivotal motion about the pin 36. For example, as illustrated in FIGS. 1, 4*a–b* and 5*a–c,* each side of the base member 12 has an arc shaped slot 38, and each side of the driving member includes a guide peg 40 which projects to guidably follow the slot 38. The slot 38 has a radius of curvature as appropriate to accommodate the relative motion between the driving member 14 and the base member 12 about the pin 38. As illustrated in FIG. 4*a,* the driving member 14 can pivot by an angle Φ relative to the base member 12, as limited by the pegs 40 and slots 38. The delivery tool 10 also includes a biasing member, such as a spring 42 (FIGS. 6*a,* 6*b*) to urge the driving member to pivot away from the base member 12.

To drive the fastening device, the delivery tool 10 includes a ram 44, as illustrated in FIGS. 5*a–c* and 6*a–b*. The ram 44 is slidably disposed near the front end of the base member 12 to move generally along a direction 46 generally perpendicular to the planar mounting surface 16. To slidably hold the ram, in the illustrated embodiment, the base member 12 includes a pair of guide channels 48 which receive side edges of the ram 44. The perpendicularly guided orientation of the ram 44 is desired so that the ram, in turn, drives the fastening device 24 perpendicularly against the mounting surface 16.

Figure 5C:
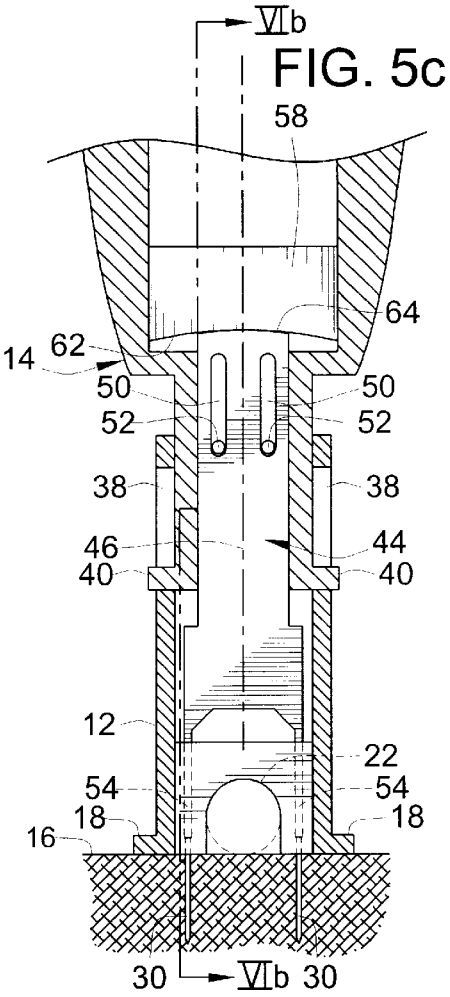
FIG. 5*c* is a fragmentary front sectional view of the delivery tool, the driving member in a position fully pivoted toward the base member, and the ram pushing the nails to project from the fastening device into the mounting surface.
Figure 5B:
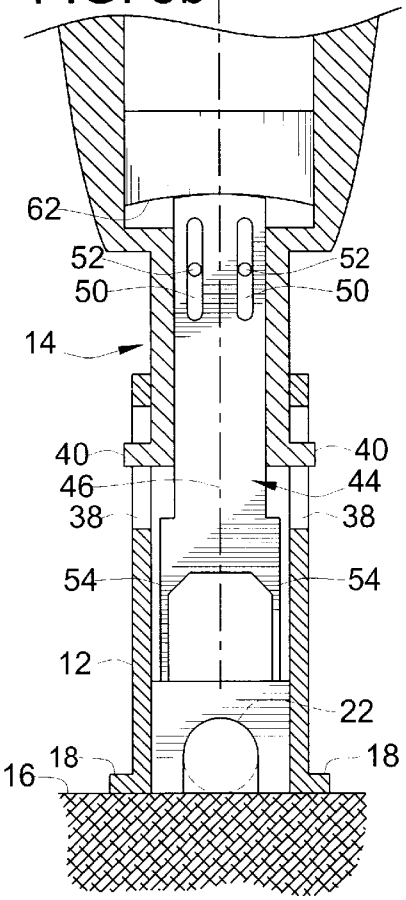
FIG. 5*b* is a fragmentary front sectional view of the delivery tool as taken generally along line VB—VB of FIG. 4*b,* the driving member in an intermediate position pivoting toward the base member, and the ram contacting the fastening device and pushing the fastening device against the mounting surface.
Figure 5A:
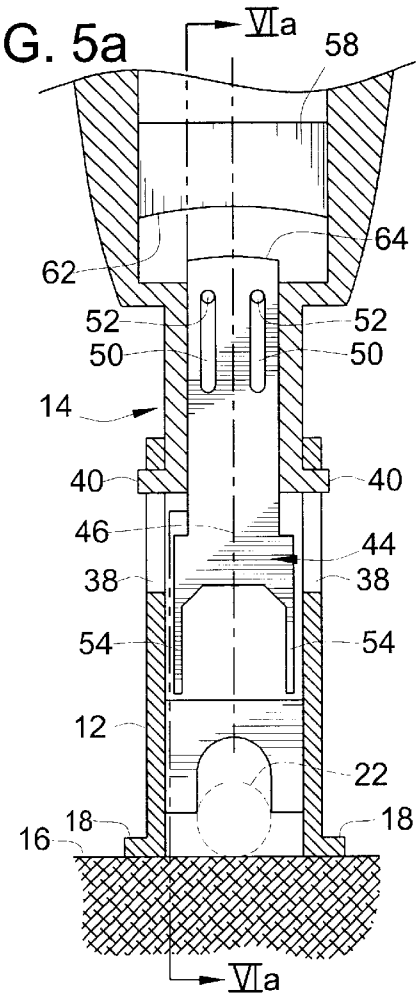
FIG. 5*a* is a fragmentary front sectional view of the delivery tool as taken generally along line VA—VA of FIG. 4*a,* the driving member in a position pivoted upwardly away from the base member, and the ram being retracted from the next available fastening device.
Figure 6B:
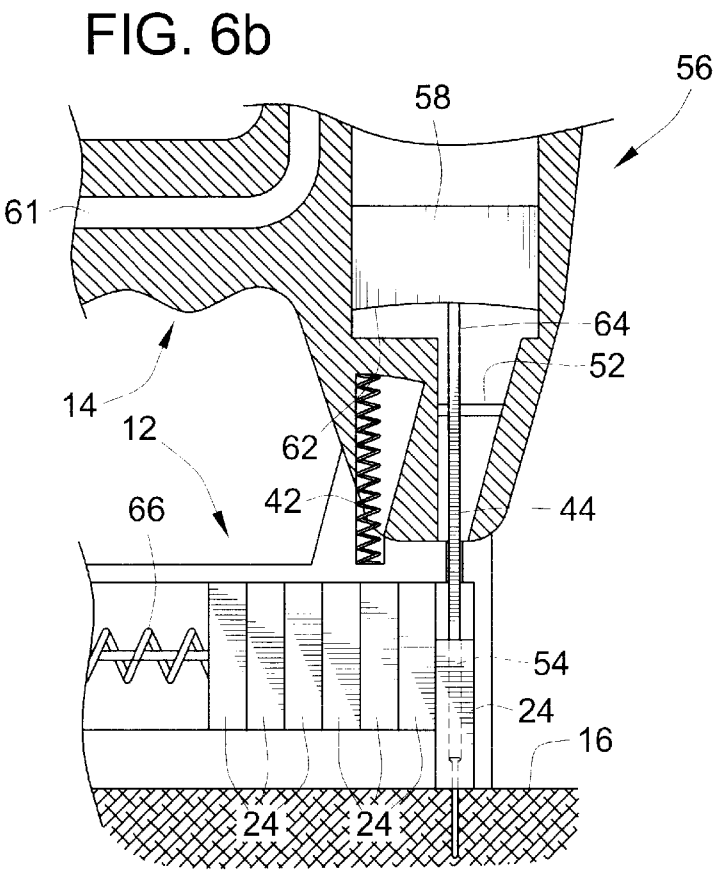
FIG. 6*b* is a fragmentary, sectional side view as taken generally along line VIB—VIB of FIG. 5*c,* the driving member in a position fully pivoted toward the base member, the ram driving the nails of the fastening device into the mounting surface, the ram contacting the force delivery member at the center of the force delivery member.
Figure 6A:
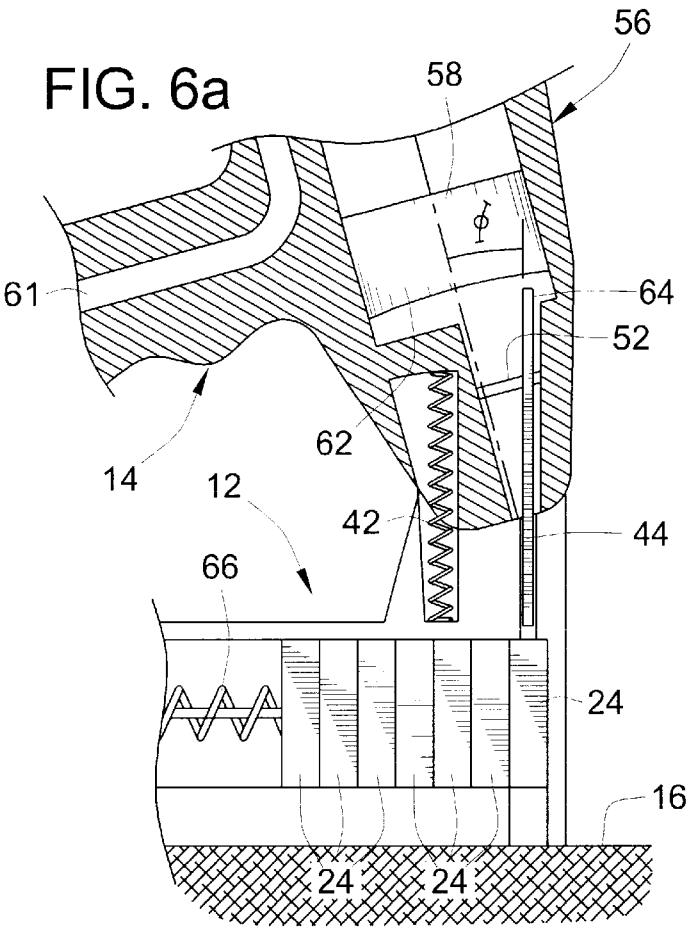
FIG. 6*a* is a fragmentary, sectional side view as taken generally along line VIA—VIA of FIG. 5*a,* the driving member in a raised position pivoted away from the base member, the ram retracted above the fastening device, and the proximal edge of the ram contacting the force delivery member forward of the center of the force delivery member.

The ram 44 is mounted to generally follow the perpendicular portion of the motion of the driving member 14 relative to the base member 12. Referring to FIGS. 5*a–c,* for example, the ram 44 includes a pair of elongate holes 50 through which a pair of guide rods 52 are respectively disposed. Each of the guide rods 52 is fixed to the driving member 14, as illustrated in FIGS. 6*a–b*. The ram 44 is generally mounted to the driving member 14. When the driving member 14 is pivoted away from the base member 12, the guide rods 52 contact the upper ends of the respective holes 50 to thereby retract the ram 44 away from the mounting surface 16. When the driving member 14 is pivoted toward the base member 12, the guide rods 52 utilize the elongated holes 50 so as not to impede the repeated driving motion of the ram 44 as the driving member 14 and the ram 44 moves perpendicularly toward the mounting surface 16.

For driving the fastening device 24 from the delivery tool 10, and for driving the nails 30 of the fastening device 24 into the mounting surface 16, the ram 44 includes a distal portion shaped to contact the top of the fastening device 24. For example, referring to FIGS. 5*a–c,* a distal portion of the ram 44 is shaped to have a pair of parallel tines 54 positioned to respectively contact the fastening device 24 at the tops of the nails.

According to an aspect of the invention, the delivery tool 10 includes a pneumatic impact mechanism 56, as illustrated generally in FIGS. 1, 4*a–b,* 5*a–c* and 6*a–b,* for driving the ram 44 with power assistance. The pneumatic impact mechanism 56 includes a force delivery member 58, illustrated in FIGS. 5*a–c* and 6*a–b,* which is driven to axially reciprocate by repeated air pulses. Other than the force delivery member 58, which is specially shaped for the application herein, as will be described in greater detail below, the pneumatic impact mechanism 56 may have a structure and operation generally similar to those of a conventional pneumatic hammer device, which is generally known. For example, pneumatic hammers are marketed by DANAIR®, PO Box 3898, Visalia, Calif. 93278 and are commercially marketed as the "RN-16 PALM NAILERS" and the "AH-15 AUTO HAMMER®". Referring to FIGS. 1 and 4*a–b,* the delivery tool 10 includes a connector 60 for connecting the delivery tool to a compressed air source. The air is delivered through a passage 61 (FIGS. 6*a–b*) in the driving member 14 to the pneumatic impact mechanism 56. As will be recognized by those skilled in the art, the force delivery member 58 may be mounted to a piston driven by compressed air, or the force delivery member 58 may itself be a piston, as illustrated. Moreover, in a preferred embodiment, the force delivery member 58 is actuated to move on a stroke of about 0.2 inches. At a preferred supply air pressure of about 80 psi to about 120 psi.

According to a preferred embodiment, the impact mechanism 56 delivers repeated impacts only until the nail(s) of the fastening device penetrates the mounting surface by a predetermined depth, at which point the impact mechanism automatically ceases. To facilitate this feature, the impact mechanism 56 is triggered by upward pressure from the ram 44 on the force delivery member 58. More particularly, the impact mechanism 56 is actuated to deliver a power assisted impact stroke whenever the force delivery member 58 is positioned a slight distance above a bottom of its stroke. The ram 44 is moved into the stroke path of the force delivery member 58 as the impact mechanism 56 is pressed downwardly against one of the fastening devices. Accordingly, the impact mechanism 56 continually actuates until the ram ceases interfering with the stroke path of the force delivery member 58, which occurs either when the ram has fully driven the nail(s) fully to the predetermined depth or when the operator stops pressing the driving member 12 toward the base member.

Actuation of the impact delivery mechanism 56 is initiated when the user pushes the driving member 14 to pivot downwardly relative to the base member 12 to a degree when the force delivery member pushes against the upper edge of the ram. (See FIG. 5*b*). As the user continues to pivot the driving member 14, the contact delivery member 58 is forced to move on an upstroke, triggering a pneumatic cycle of the impact delivery mechanism. In this manner, the contact delivery member repeatedly impacts the ram as the driving member is pivoted fully downward relative to the base member, as illustrated in FIG. 4*b*. At this point, the ram 44 cannot impede the stroke path of the force delivery member, so the actuation of the impact mechanism automatically ceases, preventing the ram from over-driving the nails of the fastening devices.

Figure 7:
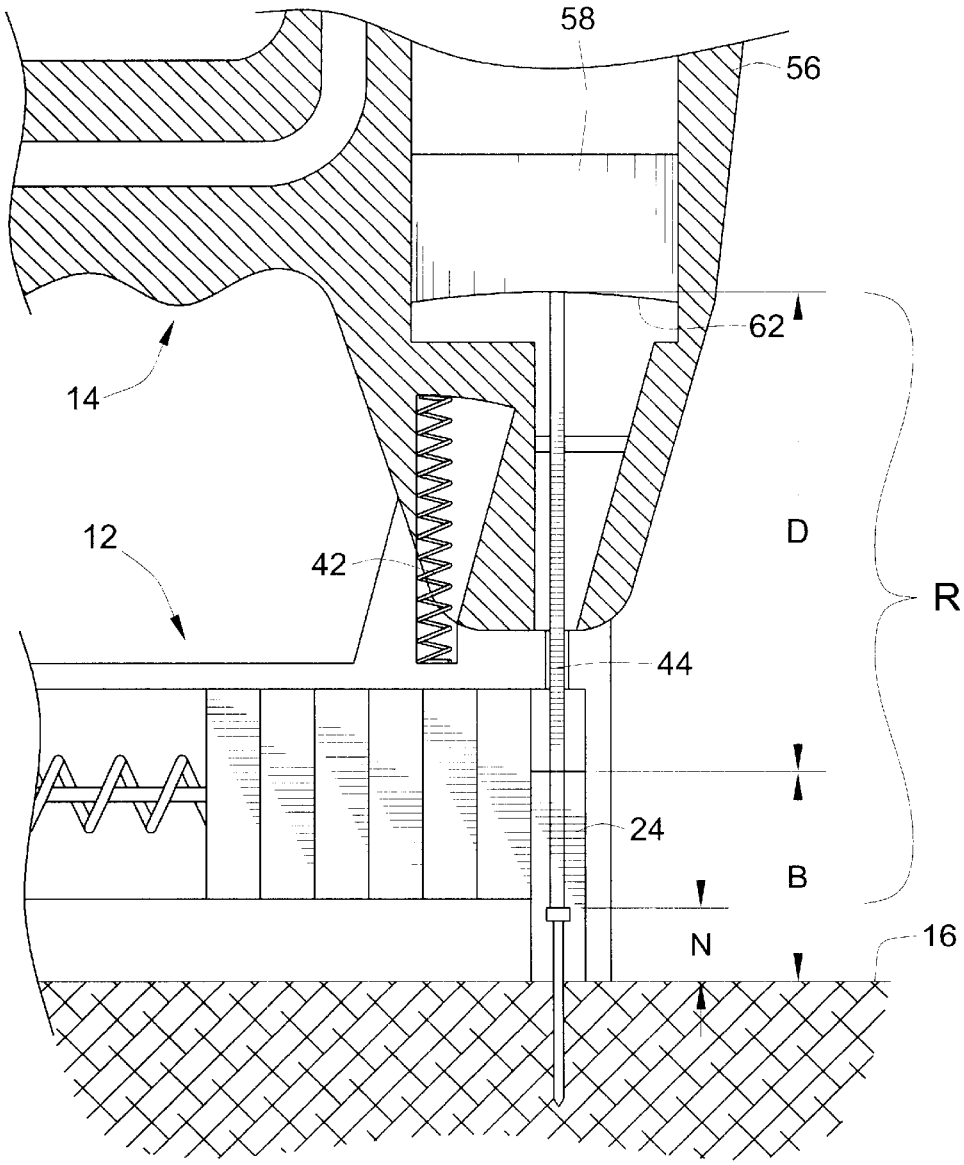
FIG. 7 is a fragmentary, sectional side view as taken generally along line VIA-VI-A of FIG. 5*a* showing various dimensions.

Referring to FIG. 7, the actuation of the pneumatic impact mechanism will be described in connection with dimensions of various components. The dimension R represents a length of the ram 44, dimension D represents a distance from the concave surface 62 to a top of the base member 12, dimension B represents a height of the base member 12, and dimension N represents a height above the mounting surface 16 to which the ram 44 will drive a top of the nail 30. When the handle 14 is positioned relative to the base 12 so that D+B−N is greater than R as the ram 44 contacts the fastening device 24, the impact mechanism 56 will be actuated. On the other hand, the impact mechanism 56 will cease to operate when D+B−N is equal to or less than R.

The present invention solves a problem of how to provide powered impacts to a surface penetrating member when resistance of the surface is not consistent from use to use and the forces afforded by the piston are not in a constant parallel relationship with the ram and fastening devices. In the example of fastening devices, the nail(s) encounter resistance that varies depending on the properties of the particular mounting surface (material, thickness, etc.). If a delivery tool delivered the nail with a single impact, the impact force would likely be too strong for many mounting surfaces, resulting in driving the nails too deep. The present invention solves this problem by delivering several quick, repeated impacts as actuated by the motion of the user simply pushing against the pivoting driving member 14 of the delivery tool 10.

According to a further aspect of the invention, the ram 44 and the force delivery member 58 are configured to contact each other for optimal force delivery through a range of relative positions which result from the pivoting movement of the driving member 14 relative to the base member 12. In a preferred embodiment, the force delivery member 58 has a concave face 62, and the ram 44 has a proximal edge 64 having a curvature shaped to generally mate against the concave face. In an embodiment, the concave face 62 may be conical.

In the illustrated example, the force delivery member 58 is annular in shape and may be rotatable. It should be understood, however, that the force delivery member 58 could be non-rotatable, and in such an embodiment, the concave face 62 is not necessarily an annular bowl shape, and could have a non-annular shape, like a trough.

More specifically, referring to FIGS. 6*a* and 6*b*, the ram 44 varies in angular position with respect to the driving member 14 and the force delivery member 58 by an angle Φ (FIG. 6*a*) as the driving member 14 is pivoted from a raised position (FIG. 6*a*) to a fully pivoted position (FIG. 6*b*). The ram 44 is slidably movable along the axis 46 with respect to the base member 12, maintaining an orientation generally perpendicular relative to the planar mounting surface 16 while the driving member 14 (and the force delivery member 58 carried thereon) pivot by the angle Φ. The concave face 62 has a curvature selected so that the ram 44 contacts the concave face 62 in a generally radial orientation relative to the concave curvature as the driving member 14 pivots by the angle Φ. This concave shape optimizes an angle of contact of the force delivery member 58 against the ram 44 to efficiently deliver impact energy generally in the direction of the axis 46. Also, the convex area of the force delivery member permits relative movement of the force delivery member 58 along a frontrear direction relative to the ram 44.

As will be recognized by those skilled in the art, the shape, curvature, and dimensioning of the force delivery member 58 and the ram 44 are selected according to design dimensions of the particular delivery tool 10, such as the distance between the ram 44 and the pivot point 36 of the driving member 14 relative to the base member and the pivot angle Φ. In one embodiment, the angle Φ is about 13 degrees and the concave face of the force delivery member has a radius of curvature of about 3 inches.

Now the operation of the delivery tool will be described. Initially, as shown in each of FIGS. 1, 4*a*, 5*a* and 6*a*, the driving member 14 is in a fully raised position relative to the base member 12 prior to driving a fastening device 24. The delivery tool 10 normally resides in this position, biased by the spring 42 (FIG. 6*a*) so that each of the guide pegs 40 is held against an upper end of the respective guide slots 38. Referring to FIG. 6*a*, the next available fastening device 24 is held at a front of the base member by a spring 66 which is acting on a rear of the stack of fastening devices 24 contained in the base member 12. The next available fastening device 24 is positioned in the path of the ram 44. Referring to FIGS. 5*a* and 6*a*, the ram 44 is held by the rods 52 in a retracted position, clear from the fastening device 24.

When the user is ready to drive a fastening device, the delivery tool 10 is placed over a section of tubing 22 (FIGS. 5*a–c*) so that the bottom surfaces 18 are seated against the planar mounting surface 16, as illustrated in FIG. 4*a*. The pneumatic impact mechanism 56 is actuated as the user then pushes the driving member 14 to pivot relative to the base member 12 and toward the mounting surface 16.

When the ram 44 initially contacts the fastening device 24, the ram may remain stationary due to the amount of play of the guide rods 52 riding within the elongate holes 50 during a short range of motion as the driving member 14 continues to pivot toward the mounting surface. The force delivery member 58 can then contact the proximal edge 64 of the ram 44, repeatedly impacting the ram 44 to move along the axis 46. As the driving member 14 continues to pivot toward the mounting surface 16, the force delivery member 58 is repeated pushed upwardly by the ram, thereby triggering a pneumatic impact cycle, each resulting in a power assisted impact of the delivery member 58 against the ram. The impacts against the ram 44 push the fastening device 24 downward so that the U-shaped housing 24 seats against the mounting surface 16, as illustrated in FIG. 5*b*.

The tines 54 of the ram 44 contact the tops of the nails 30 of the fastening device 24. Accordingly, as the driving member 14 is pivoted further toward the mounting surface 16, the ram 44 drives the nails 30 to project from the U-shaped housing 26 and into the mounting surface 16. The repeated impact energy delivered from the force delivery member 58 to the ram 44 is, in turn, delivered from the ram 44 to the nails 30, driving the nails 30 generally perpendicularly into the mounting surface 16. As the ram 44 is driven, the tines 54 enter cavities in the U-shaped housing 26 previously occupied by the respective nails 30.

The user continues to push driving member 14 to pivot toward the mounting surface 16 until a fully pivoted position is reached, as illustrated in FIG. 4*b,* FIGS. 5*c* and 6*b.* At this point, referring to FIGS. 5*c* and 6*b,* the tines 54 of the ram 44 have substantially entered the U-shaped housing 26 and have driven a portion of each of the nails 30 into the mounting surface 16 to a desired depth. More particularly, the tines 54 are dimensioned to drive the nails to a predetermined depth such that the head (FIGS. 3*a* and 3*b*) of each nail 30 is about one-eight inch above the mounting surface 16, the head abutting an internal shoulder of the housing of the fastening device 24. Referring to FIG. 6*b,* when the driving member 14 is in the fully pivoted position, the direction 46 of the ram 44 is generally parallel with the direction of the motion of the force delivery member 58 so that the proximal edge 64 of the ram 44 contacts a generally central position of the force delivery member 58. In other embodiments, the ram need not contact a particular position of the force delivery member 58.

The driving member 14 can then be lifted to pivot away from the mounting surface 16, thereby retracting the ram 44 to the position illustrated in FIGS. 5*a* and 6*a.* The delivery tool 10 is lifted away from the mounting surface 16, leaving the driven fastening device 24 securely mounted to the mounting surface 16. The U-shaped housing 26 of the mounted fastening device 24 is oriented generally perpendicularly to the mounting surface, holding the tubing 22 (FIG. 5*c*) in a desired position.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. For example, it will be recognized that the delivery tool is not limited to a "pivoting" motion of the force delivery member, as any appropriate structure could be used to movably mount the driving member to the base member so that the force delivery member is movable generally in the direction of the ram and toward the mounting surface. This motion may be linear or otherwise. The inventors expect skilled artisans to employ any such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A delivery tool comprising:

a base member having a chamber for holding at least one fastening device, the base member having at least one bottom surface adapted to support the delivery tool against a generally planar mounting surface; and a driving member pivotally mounted to the base member at a rear end of the tool, the driving member slidably mounted to the base member at a front end of the tool to move along an arc resulting from pivotal motion between the driving member and the base member;

an impact mechanism mounted to the driving member, the mechanism including a force delivery member which is movable in a reciprocating manner relative to the driving member; and a ram slidably mounted to the of the base member near the front end to move generally along a guided direction perpendicular to the planar mounting surface, a distal portion of the ram being operable to push a fastening device from the chamber as the driving member is pivoted toward the base member, the ram having a proximal end positioned to receive at least one impact force from the force delivery member when the ram pushes the fastening device;

wherein the force delivery member has a concave face, the proximal edge of the ram being shaped to generally mate against a curvature of the concave face as the driving member pivots relative to the base member.

2. The delivery tool of claim 1, wherein the ram contacts the concave surface in a generally radial orientation relative to the curvature of the concave face.

3. The delivery tool of claim 1, wherein the concave face and proximal edge of the ram are shaped so that the concave face delivers impact forces to the ram toward the fastening device in a direction generally perpendicular to the mounting surface.

4. The delivery tool of claim 1, wherein a portion of the movement up the concave face can be along a front to rear direction relative to the ram.

5. The delivery tool of claim 1, wherein the impact mechanism is pneumatically actuated.

6. The delivery tool of claim 1, wherein the base member is shaped to receive and hold a length of tubing.

7. The delivery tool of claim 1, wherein the ram is operable to push the fastening device so that at least a portion of the fastening device penetrates said mounting surface.

8. The delivery tool of claim 1, wherein each of the fastening devices includes: a generally U-shaped body with a pair of parallel sides and at least one nail being at least partially contained within a respective one of the sides; wherein the ram has at least one tine which drives the at least one nail to partially project from the U-shaped body into the mounting surface.

9. The delivery tool of claim 8, wherein the ram pushes the fastening device from the chamber as it drives the at least one nail.

10. The delivery tool of claim 1, further comprising a biasing member to urge the driving member to pivot away from the base member.

11. The delivery tool of claim 1, wherein the driving member includes a handle shaped to be gripped by a user to pivot the driving member toward the base member.

12. The delivery tool of claim 1, wherein the ram is pulled clear from the chamber when the driving member is pivoted away from the base member.

13. The delivery tool of claim 1, wherein the impact mechanism is operable to actuate a reciprocating motion of the force delivery member when the ram pushes a fastening device.

14. The delivery tool of claim 13, wherein the impact mechanism is operable to cease actuating a reciprocating motion of the force delivery member when the ram ceases to push a fastening device.

15. The delivery tool of claim 14, wherein the impact mechanism ceases when a portion of the fastening device has penetrated the mounting surface by a predetermined depth.

16. The delivery tool of claim 1, wherein the concave face of the force delivery member is generally conical.

* * * * *